United States Patent [19]

Jayne

[11] 4,299,433

[45] Nov. 10, 1981

[54] CABLE CONNECTOR

[75] Inventor: Max L. Jayne, North Warren, Pa.

[73] Assignee: GTE Products Corporation, Stamford, Conn.

[21] Appl. No.: 81,606

[22] Filed: Oct. 3, 1979

[51] Int. Cl.[3] ..... H01R 13/625

[52] U.S. Cl. ..... 339/91 R; 339/176 MP

[58] Field of Search ..... 339/91 R, 206 R, 206 P, 339/208, 17 L, 17 LC, 17 LM, 176 MP, 178 B, 103 R, 103 M, 107

[56] References Cited

U.S. PATENT DOCUMENTS

| | | | |
|---|---|---|---|
| 3,605,070 | 9/1971 | Krafthefer | 339/91 R |
| 3,828,302 | 8/1974 | Cieniawa et al. | 339/103 M X |
| 4,002,389 | 1/1977 | Mammel | 339/103 M X |
| 4,010,998 | 3/1977 | Tolnar et al. | 339/91 R |

*Primary Examiner*—Eugene F. Desmond

*Attorney, Agent, or Firm*—Robert E. Walter

[57] ABSTRACT

A cable connector having a pluggable portion which provides for rapid connect and disconnect of a cable with a circuit board includes a latching member projecting below the pluggable portion which is adapted to snap-lock with an exterior portion of a receptacle.

3 Claims, 16 Drawing Figures

CABLE CONNECTOR

TECHNICAL FIELD

The present invention relates to electrical connectors and more particularly to a system and individual connectors for electrically interconnecting a cable of the type having a plurality of conductors to a printed circuit board.

A particular use for the connectors of a nature described is in the telephone switching field. It is often desirable in telephone switching equipment to provide for electrical interconnection between a cable and a printed circuit board which serves to modify an incoming electrical signal transmitted via the cable. It is also desirable to transmit the modified signal from the board through other electrical cables. Rapid inter connection and interchangeability of the various cables being connected to the circuit board is a beneficial feature.

Many such assemblies are of relatively complex design which require several multiple manual operations in order to satisfactorily provide the desired interconnections. Assembly, repair and disassembly is both time-consumming and expensive by manufacturing standards.

The printed circuit boards typically used for the above applications may include a plurality of conductive pads on the marginal portions thereof or a plurality of cladded bores on the board. It is desirable to develop a flexible system wherein the multiple individual conductors of a cable may be conveniently terminated to either a plurality of plated bores or terminated to conductive pads on the circuit board. Due to the fact that the individual conductors of a cable are generally coated with an insulating material, a convenient system for connecting the conductors to a circuit board should provide for rapid and accurate termination of individual conductors.

BACKGROUND ART

U.S. Pat. No. 4,047,785 to Jayne describes a connector assembly having a separable cover means which slidably engages an insulative housing to cover the wire in addition to defining an opening for receiving a wire. The contacts positioned within the housing have a slotted end portion for electrically engaging the wire and an opposing end portion for slidably engaging a male pin.

U.S. Pat. No. 4,037,906 to Jayne relates to a connector having an insulating housing and contacts having a contacting portion within the housing and another portion extending from the housing. A cover is pivotably mounted to the housing for covering a recessed area within the housing.

U.S. Pat. No. 4,106,838 to Jayne et al relates to a flat cable connector assembly adapted to receive a flat cable having a plurality of aligned conductors and adapted to be plugged into an array or grid of conductor pins to interconnect the cable conductors and pins. A flat cable is positioned between a top and bottom body so that when the top and bottom bodies are assembled the contacts pass between adjacent conductors in the cable.

DISCLOSURE OF THE INVENTION

In accordance with the principles of the present invention, there is provided an electrical connector of the type adapted to interconnect a plurality of individual cable conductors with a plurality of contacts interior a receptacle comprising a cover member having a top opening for receipt of a cable therethrough, an elongated body having a plurality of terminals mounted thereto adapted to engage said individual conductors, said elongated body and said cover forming a pluggable portion adapted to mate with said receptacle and provide electrical connection of said terminals with said contacts, a latching member projecting below said pluggable portion and adapted to snap lock with an exterior portion of said receptacle.

DESCRIPTION OF PREFERRED EMBODIMENTS

Figure 1:
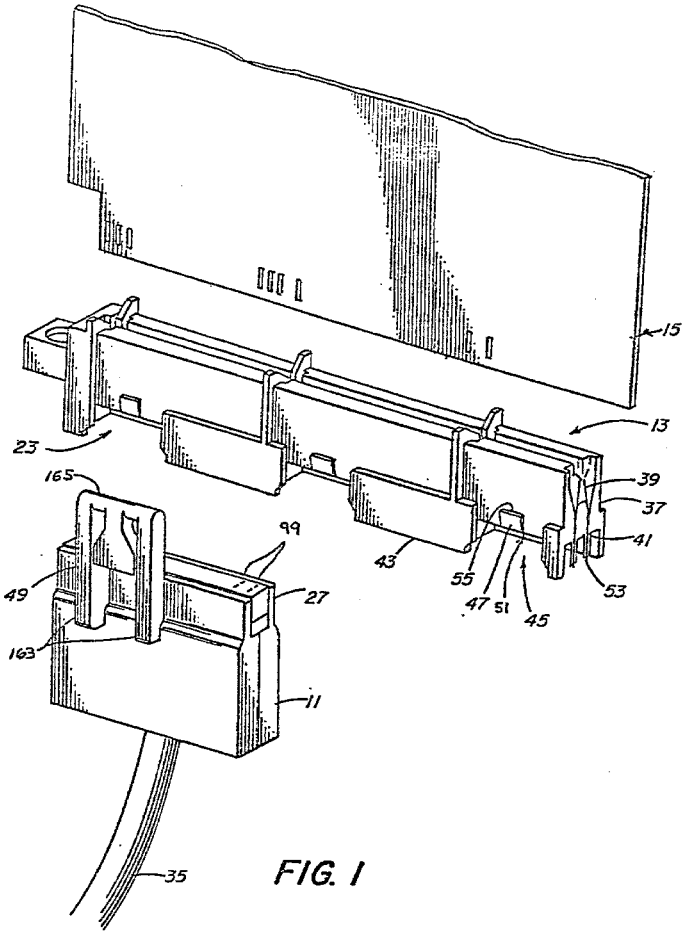
FIG. 1 is an exploded isometric view showing the interconnection of the cable connector with the edge of circuit board.

FIG. 1 illustrates the interconnection of cable connector 11 to a circuit board 15 via an edge mounted header or connector 13 for providing electrical connection of a cable 35 with the conductive portions or pads 31 on a circuit board 15. The edge mounted header 13 includes a receptacle portion illustrated at 23 for receiving a pluggable portion 27 of the cable connector 11.

Figure 2:
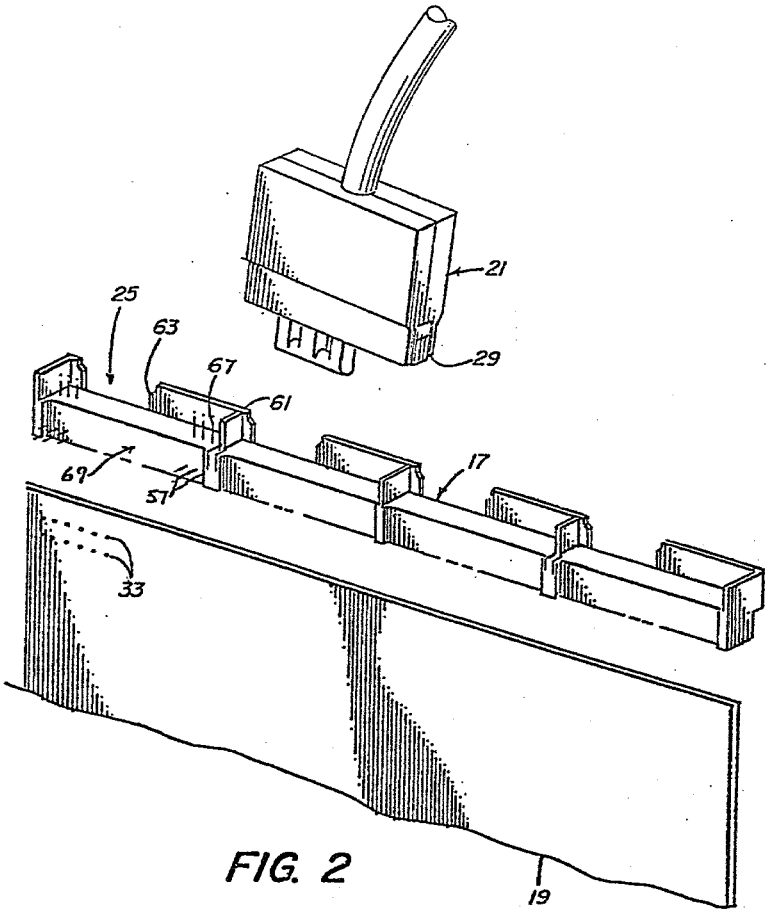
FIG. 2 is another exploded isometric showing the interconnection of the cable connector with plated through holes of a circuit board.
Figure 4:
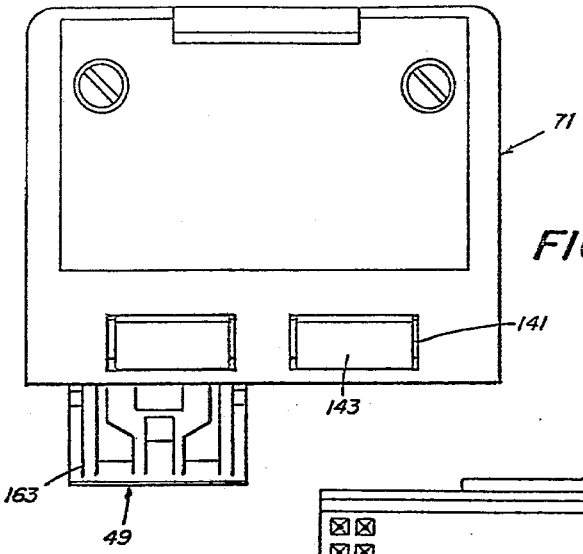
FIG. 4 is a front elevational view of the cable connector.
Figure 5:
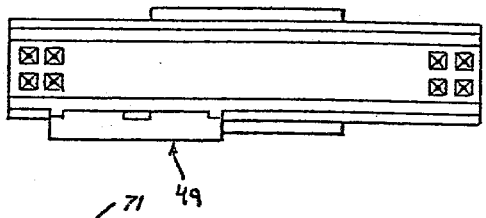
FIG. 5 is a bottom elevational view of the cable connector of FIG. 4.

FIG. 2 illustrates a similar arrangement wherein cable connector 21 has a plugable portion 29 adapted to mate in a receptacle portion 25 of a side mounted header or connector 17. The side mounted header 17 is adapted to provide interconnection with a plurality of plated through holes 33 provided on a circuit board 19. The connector system of the present invention is suited for electrically connecting the individual conductors of a wire type cable 35 to either conductive pads 31 or plated through holes 33 of respective boards 15 and 19.

The edge mounted header 13 includes a generally rectangular mounting member 37 having a central opening or zone therein for receiving circuit board 15. A plurality of apertures 41 which are arranged along a pair of spaced parallel rows have a plurality of contacts 39 mounted therein so that terminal engaging portions 53 which are pin shaped project outwardly from a bottom surface 51 thereof.

The electrical contacts 39 are retained in apertures 41 by a friction type fit so that flat portions or fingers of opposite contacts 39 face each other. The flat portions are bent inwardly to form a circuit board engaging portion which wipes against the conductive pads 31 as the circuit board 15 is inerted into the receiving zone of the mounting member 37. The contacts 39 yield outwardly due to their resilience and generate forces which serve to hold the circuit board 15 in place and establish electrical continuity therewith.

The contacts 39 which are bent outwardly at the upper end include tabs. The mounting member 37 includes partitions which separate adjacent contacts 39 and prevent short circuiting. The partitions include shoulder portions for engaging the tabs on the upper end of the contacts 39 for limiting the inward deflection of the contacts 39 into the receiving zone.

A pertaining flange 43 projects outwardly in a direction normal to the bottom surface 51 so as to form a receptacle about the terminal engaging portion 53. The flange 43 includes a slot 45 extending from an outer edge inwardly toward the bottom surface 51 of mounting member 37. The slot 45 is of sufficient width to receive the latching member 49 on cable connector 11. The mounting member 37 includes a protrusion 47 adjacent the bottom edge of bottom surface 51 intermediate the side edges of slot 45. As illustrated in detail in FIG. 1, the protrusion 47 is in the form of a tapered runner inclined upwardly and outwardly from the edge of bottom surface 51 and including an abrupt portion spaced inwardly from the bottom edge for engaging latching member 49. The flange 43 forms a receptacle or socket 23 which together with the slot 45 which forms a channel, serve to align and guide the cable connector 11 into the proper position. The protrusion 47 which lies along the channel path engages the cable connector 11 for securing the cable connector 11 to the connector 13 with respective contacts 39 engaging respective terminals 99 of the cable connector 11.

Figure 15:
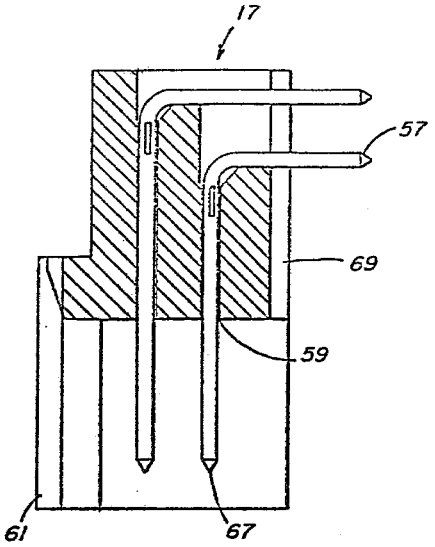
FIG. 15 is a side elevational view in section of a header assembly.

FIG. 2 illustrates in perspective the side mounted header 17 with FIG. 15 representing a cross section thereof. Side mounted header 17 includes a mounting member 69 with a plurality of apertures 59 therein arranged along a pair of parallel spaced rows. A plurality of contacts 57 are secured or retained to mounting member 69 in the apertures 59. Each of the contacts 57 is bent at a right angle so as to project outwardly from adjacent faces of the rectangular mounting member 69. The receptacle or socket 25 and the features relating thereto for receiving a plugable portion 29 are similar to the features as described hereinbefore with regard to edge mounted header 13. The projecting pin portion 67 of contacts 57, slot 63, flange 61 and the protrusion in the form of a tapered runner (not shown in FIG. 2) perform, respectively, similar functions and are of similar structure to the flange 43, slot 45, pins 53, and protrusion or tapered runner 47 as described with respect to the edge mounted header 13.

Figure 3:
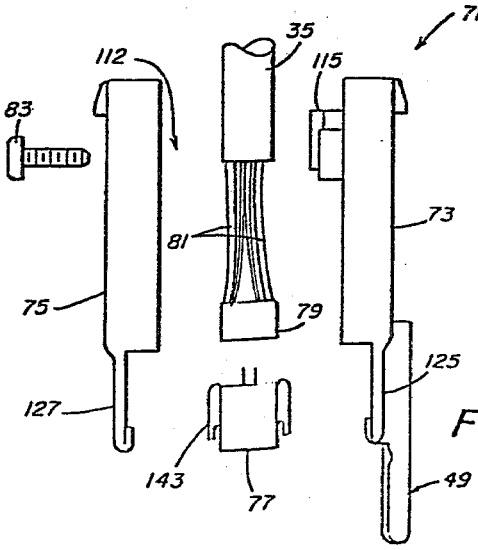
FIG. 3 is a schematic exploded side view of the cable connector.
Figure 8:
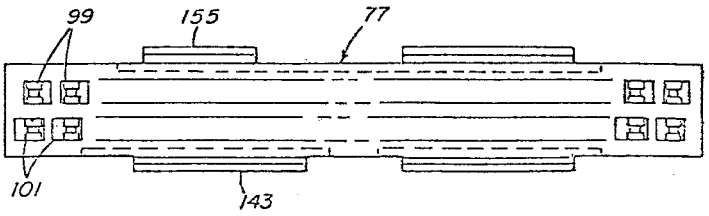
FIG. 8 is a top elevational view of the bottom body shown in FIG. 6.

The exploded view of FIG. 3 illustrates how the various parts of the cable connector 11 can be assembled to terminate individual conductors 81 from cable 35. As illustrated, the cable connector 11 includes a cover member 71 including a front section 73 and a mating back section 75. A bottom body 77 and top body 79 are interposed the back section 75 and front section 73. A fastening means 83 in the form of a self-tapping screw is provided in respective sections for securing a top portion of the back section 75 and front section 73 together.

Figure 13:
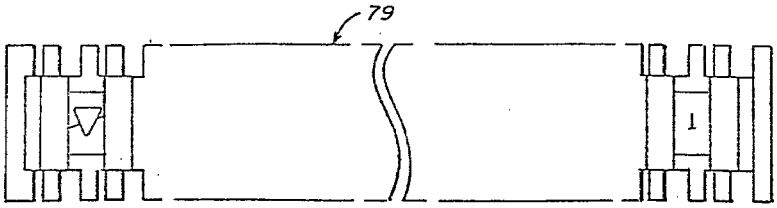
FIG. 13 is a top elevational view of the top body shown in FIG. 12.
Figure 12:
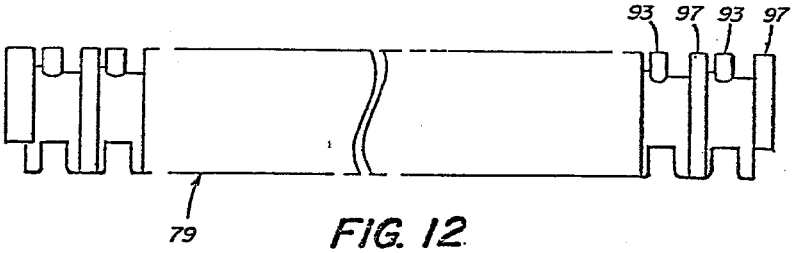
FIG. 12 is a side elevational view of the top body.
Figure 14:
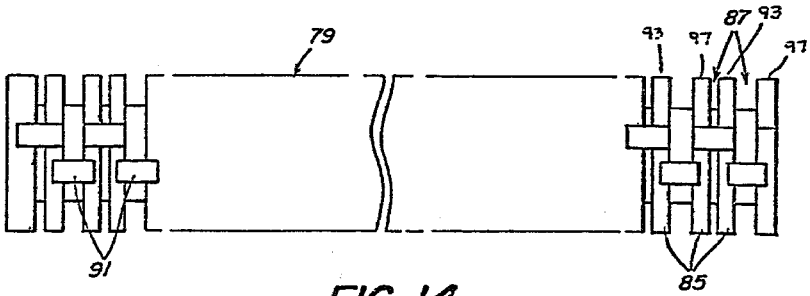
FIG. 14 is a bottom elevational view of the top body as shown in FIG. 12.

The top body 79 which is illustrated in the drawings in FIGS. 12, 13 and 14 is a rectangular shape elongated body having a plurality of partitions 85 along a bottom face thereof forming grooves 87 which are adapted to hold a plurality of conductors 81 in parallel spaced relation along a substantially common plane. As illustrated in FIG. 12, alternate partitions 93 are more closely spaced to one of the alternate adjacent partitions 97 so as to accommodate alternating individual conductors of different dimensions. The partitions 85 project downwardly below the bottom surface and are arranged to guide or align conductors 81 over the alternately spaced recesses 91.

The embodiment as above described is particularly desirable where it is necessary to terminate a cable 35 having conductors 81 including bare wires as well as insulated wires. This is particularly useful with cables of the coaxial type having a conductive mylar outer layer with a conducting bare wire in contact therewith. With the alternate spacing of the partitions 85 as illustrated in FIG. 12, the bare wires having a small diameter may be guided through the narrow groove between partitions 97 and 93 while the insulating wire having a larger diameter may be guided through the larger groove through the partition 93 and 97. Due to the fact that alternate partitions 93 do not extend completely along the sides of the top body, each of the insulating wires has adjacent thereto a bare wire so as to further prevent cross talk in the connector itself. It is contemplated that alternate partitions 93 may have any spacing desirable depending on the width of the wires to be terminated. If the conductors are all insulated wire conductors of the same diameter, it would be desirable to have the partitions 93 evenly spaced from adjacent partitions 97.

The configuration of the bottom body 77 is more fully illustrated in FIG. 6 through 9. The bottom body 77 is an elongated rectangular insulating material having a plurality of openings 101 extending from one face thereof to an opposite face. The openings 101 are arranged along a pair of spaced parallel rows. A plurality of terminals 99 are mounted on the bottom body 77 and retained in the respective openings 101.

Figure 16:
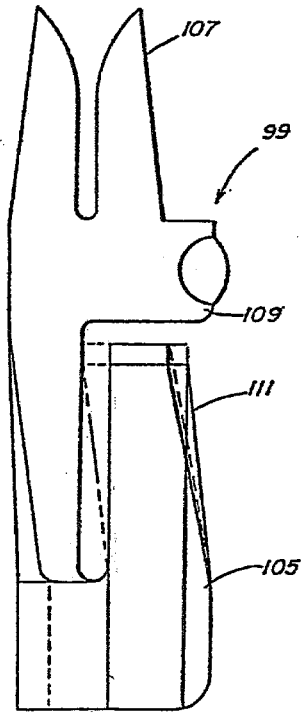
FIG. 16 is a side elevational view of a contact.

The configuration of one of the terminals 99 is illustrated in detail in FIG. 16. Each of the terminals 99 includes contact engaging portion in the form of a female disconnect portion 105 at one end, a conductor receiving portion 107 at the other end, and an intermediate retaining portion 109. The female disconnect portion 105 which is associated with one face of bottom body 77 includes a pair of engaging elements 111 which make mechanical and electrical contact with contacts 57 or 59 as may be present in a respective edge mounted header 13 or side mounted header 17 as previously discussed. The conductor receiving portion 107 which extends outward from the other face of bottom body 77 is generally in the form of opposing knife edges which are suited for piercing the insulation and engaging the bare wire of the conductor 81 for making electrical contact therewith. The intermediate retaining portion 109 is in the form of a projection which makes frictional contact with a respective opening 101 for holding each of the contacts 99 in place.

The conductive receiving portion 107 is offset from the longitudinal axis of the contact 99 and projects outwardly along one side thereof. The contacts are mounted along the pair of parallel rows in openings 101 so that the conductor receiving portions 107 of one row of contacts face one direction and the offset portion of the contacts of another row face the opposite direction.

The lower face of the top body 79 mates with the upper face of the bottom body 77 so that the aligned recesses 91 in the top body 79 are substantially in alignment and adapted to receive respective conductive receiving portions 107.

As the partitions 85 of the top body 79 engage the top face of the bottom body 77, passageways between the partitions 85 and the top surface of the bottom body 77 are formed which accommodate respective conductors 81 and provide for accurate alignment so as to provide proper engagement of the conductive receiving portions 107 with appropriate conductors 81.

A cover member 71 includes a top opening 113 for receiving cable 35 therethrough. The front section 73 includes a jaw 115 for gripping the cable 35. As the front section 73 and back section 75 are secured together the cable 35 is securely held by the jaw 115 between sections 73 and 75. The front and back sections 73, 75 each include respective peripheral flanges which mate to form respective top and side walls of the cover 71. A chamber 112 formed interior the cover 71 permits individual conductors 81 to be separated from the cable sheathing and spaced apart.

The cover 71 includes a pair of opposed retaining flanges 125, 127 depending from the cover 71 on either side of the bottom opening 123 for holding the top and bottom bodies 79, 77 in assembled relationship interposed the flanges 125, 127 with the conductive receiving portions 107 engaging respective conductors 81. The flanges 125, 127 together with the top body 79 and bottom body 77 form a pluggable portion 129 adapted to fit into the respective receptacle 23 or receptacle 25 so that the contact engaging portions 105 mate with respective electrical contacts 39.

The top body 79 is held in position between the fixedly mounted bottom body 77 and the cover 71 intermediate the flanges 125, 127. Upward movement of the top body 79 in relation to the cover 71 is prevented by engagement with the bottom edges of respective side walls of the cover member 71 which are spaced away from the top face of the bottom body 77 a distance corresponding height of the top body 79.

Figure 6:
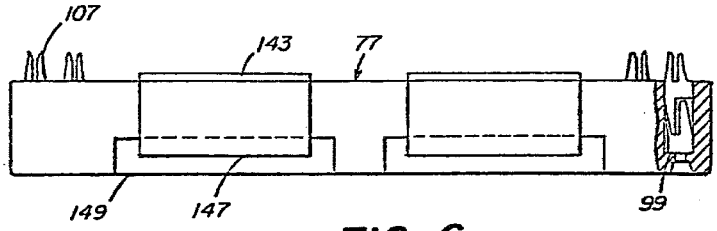
FIG. 6 is a side elevational view of the bottom body.
Figure 7:
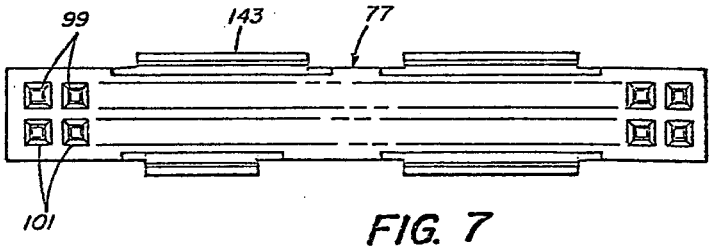
FIG. 7 is a bottom elevational view of the bottom body shown in FIG. 6.

The flanges 125, 127 and the bottom body 77 include complementary holes 141 and matching projecting bosses 143 for positioning the bottom body 77 and the cover 71. As illustrated in detail in FIG. 10, the holes 141 comprise longitudinal slots with each slot having the lower edge portion 145. As shown in FIG. 6, each of the projecting bosses 143 include a lip portion 147 which overlaps the lower edge portion 145 when the bottom body 77 and the flanges 125, 127 are assembled. The bottom body 77 is thus held stationary with respect to the cover 71.

At least one of the holes 153 (FIG. 10) and one of the matching projecting bosses 155 (FIG. 8) have matching dimensions different than the dimensions of the remaining holes 141 and projecting bosses 143 for polarizing the bottom body 77 and the cover member 71.

Figure 9:
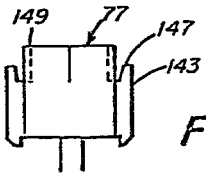
FIG. 9 is an end elevational view of the bottom body shown in FIG. 6.
Figure 11:
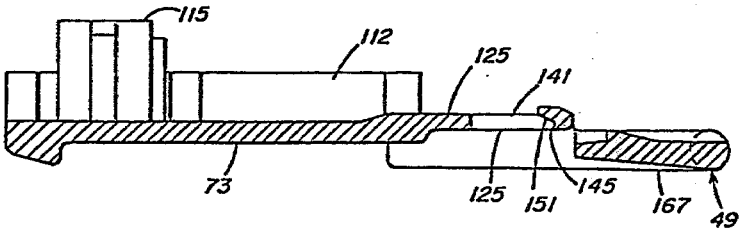
FIG. 11 is an end elevational view along section 11—11 of the cover as illustrated in FIG. 10.

To provide for a smooth plugable portion 129, the lower edge portion 145 as shown in FIG. 11 extends inwardly to form a recess 151 on one side of the cover 71 and a rib 150 on the other side of the cover 71. The bottom body 77 has a matching recess 149 as shown in FIG. 9 for receiving the rib 150 with the lip 147 being substantially flush with the exterior surface of the plugable portion 23.

Figure 10:
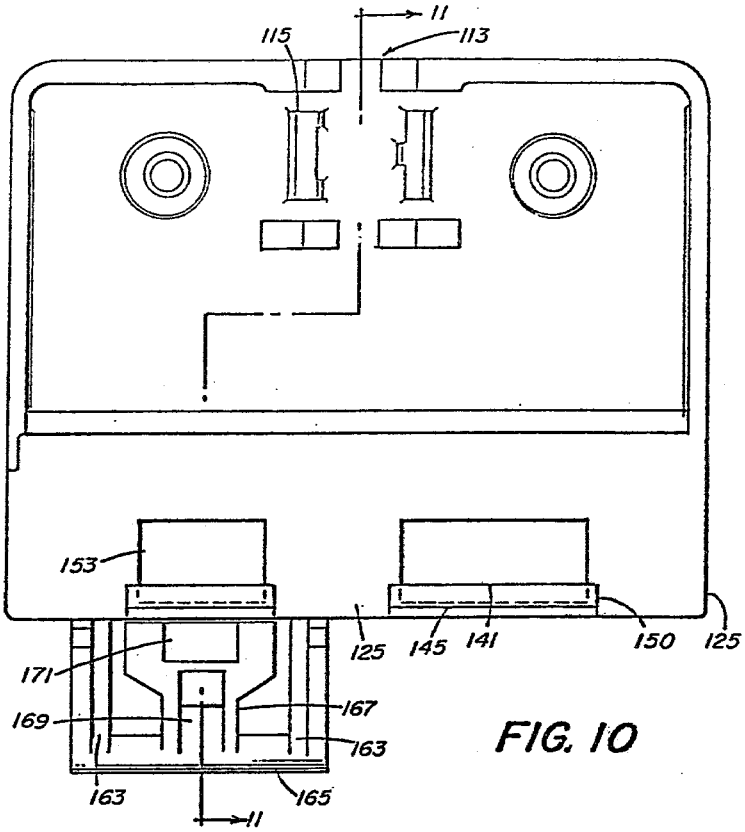
FIG. 10 is a side elevational view of the inside surface of the cover of FIG. 4.

As illustrated generally in FIG. 1 and in more detail in FIGS. 10 and 11, the cable connector 11 includes a latching member 49 mounted on the front section 73. The latching member 49 comprises a pair of arms 163 in substantially parallel alignment which project outwardly from at least one flange 125. A bar 165 which is connected to the arms 163 is spaced from the flange 125. A locking member 167 extends toward the pluggable portion 23 or bottom edge of flange 125 for yieldably engaging an exterior portion of a receptacal 23. Due to the torsional properties of the bar 165, the free end of the locking member 167 yieldably pivots about the bar 165. The locking member 167 includes a tapered recess 169 extending from a position adjacent the bar 165 inwardly toward the flange 125 and an abrupt recess 171 spaced inwardly of the tapered recess 169. As the locking member 167 is inserted into the slot 45 and the tapered runner 47 guides the tapered recess 169, the locking member 167 is guided inwardly until the abrupt recess 171 meets the abrupt portion 55 of tapered runner 47 and the locking member 167 snaps inwardly.

In operation, the edge mounted connector 13 may be electrically connected to a circuit board 15 having conductive portions 31 on marginal edges and the side mounted header 17 may be connected to the same board or different circuit board 19 having plated through holes 33. Once the appropriate header 13 or 17 is connected, cables 35 may be connected to the board 15 or 19 via the cable connector 11. The pluggable portion 27 of the cable connector 11 may be fitted to within receptacle portion 23 or 25 so that the terminals 103 engage respective contacts 39, 67 to complete the circuit. The latching member 161 assures the mechanical integrity of the system.

INDUSTRIAL APPLICABILITY

The connector of the present invention may be used in conjunction with communication equipment to provide electrical interconnection and rapid disconnect of a cable having a plurality of individual conductors with a circuit board.

I claim:

1. An electrical connector for interconnecting a plurality of individual cable conductors with a plurality of contacts interior a receptacle, said receptacle being, of the type having an outwardly projecting flange about said plurality of contacts and including a protrusion on the exterior of said receptacle, said flange having a slot forming a path toward said protrusion, said electrical connector comprising a cover member having a top opening for receipt of a cable therein, an elongated body having a plurality of terminals mounted thereto adapted to engage individual conductors, said elongated body and said cover forming a pluggable portion adapted to mate interior said flange of said receptacle and provide electrical connection of said terminals with said contacts, a latching member projecting below said pluggable portion and adapted to be inserted into the slot when said pluggable portion is mated with said flange, said latching member comprises a pair of arms in substantially parallel alignment projecting outwardly from said pluggable portion, a bar connected between said arms spaced from said pluggable portion, a locking member connected to said bar and extending toward said pluggable portion intermediate said arms, an abrupt recess on said locking member spaced inwardly of said bar, said locking member being adapted to yieldably engage said protrusion and impart cantilever forces to said bar, and said abrupt recess being adapted to snap lock with said protrusion for securing the pluggable portion to the receptacle when said pluggable portion is mated with the interior of said flange.

2. An electrical connector according to claim 1 wherein said body is rectangular and includes a pair of faces, a plurality of openings extending from one face to another face and arranged along a pair of spaced parallel rows, said terminals being retained in said openings, each terminal having a conductor receiving portion extending outwardly from one face and a contact engaging portion associated with the other face.

3. An electrical connector according to claim 2 including an elongated top insulating body having a plurality of partitions adapted to hold a plurality of conductors in parallel spaced relation along a substantially common plane, said cover member being adapted to hold said top body and said body in assembled relationship with the conductor receiving portions of said terminals adapted to engage respective conductors.

* * * * *